US008727178B1

(12) United States Patent
Carter et al.

(10) Patent No.: US 8,727,178 B1
(45) Date of Patent: May 20, 2014

(54) CONDIMENT PACKET DISPENSER

(76) Inventors: Irene Carter, Chesapeake, VA (US); Roger Henry Gagnon, Great River, NY (US)

( * ) Notice: Subject to any disclaimer, the term of this patent is extended or adjusted under 35 U.S.C. 154(b) by 232 days.

(21) Appl. No.: 13/300,593

(22) Filed: Nov. 20, 2011

(51) Int. Cl.
*G07F 11/00* (2006.01)
*G07F 11/12* (2006.01)

(52) U.S. Cl.
USPC ..... 221/6; 221/126; 221/121; 221/14; 221/113; 221/270; 221/154; 221/281; 221/283; 221/289; 221/155; 221/245; 221/20; 221/11; 221/77; 194/240; 194/253

(58) Field of Classification Search
USPC ..... 221/126, 6, 121, 14, 113, 270, 154, 221/281, 283, 289, 155, 245, 20, 11, 77; 194/240, 253
See application file for complete search history.

(56) References Cited

U.S. PATENT DOCUMENTS 1,977,092 A * 10/1934 Scurlock ..... 211/77
5,172,828 A * 12/1992 Ficken et al. ..... 221/11
5,605,249 A * 2/1997 Gonyea ..... 221/6
6,029,828 A 2/2000 Robbins
6,308,860 B2 * 10/2001 Eagle ..... 221/131
6,786,359 B1 9/2004 Schroeder
7,320,415 B2 1/2008 McGuyer
2010/0193541 A1 * 8/2010 Tester et al. ..... 221/97
2010/0243684 A1 * 9/2010 McGuyer ..... 222/559

* cited by examiner

*Primary Examiner* — Gene O. Crawford
*Assistant Examiner* — Rakesh Kumar

(57) ABSTRACT

A condiment packet dispenser that includes a cylindrical shaped housing containing an open top with a plurality of radially partitioned chambers. Each chamber contains a cylindrical shaped container that stores individual condiment packets in a radial manner. The dispenser is operated by pushing a button which sends a signal to a motor control board. The motor control board powers a motor having a spur gear which turns the selected condiment container until the condiment packet is aligned with a drop chute. The packet then falls thru the drop chute and is available for picking up by the customer. There is also a cylindrical shaped top lid which is removable when new condiments need to be loaded to replenish the dispenser. The condiment dispenser sits on top of a base stand that may either be rigidly mounted or may be rotated to choose a condiment.

6 Claims, 6 Drawing Sheets

CONDIMENT PACKET DISPENSER

FIELD OF THE INVENTION

This invention relates generally to the field of condiment dispensers, and in particular to an automated dispensing machine that dispenses condiment packets.

BACKGROUND OF THE INVENTION

Condiment packets are frequently used in the restaurant industry as a convenient and low cost method of supplying customers with food condiments such as relish, mustard, ketchup and mayonnaise. Traditionally, restaurant owners dispense condiments to customers by filling condiment trays with various condiment packets and letting the customers take what they need.

However, this conventional system of dispensing condiments has several major flaws. The first and perhaps most important flaw is that the condiment tray method is not very sanitary. Condiment packets left in open trays can become contaminated over time with bacteria and germs from the hands of customers who reach in and grab condiments out by hand. Frequently many customers will grab too many condiments on the first try and drop extra condiment packets back into the tray with their fingers. Even though condiment packets are sealed, bacteria and germs left on the outside surfaces of the condiment packet may still end up in the condiment itself once the packet is torn open.

Another common drawback to condiment dispenser trays is that this practice allows customers to waste condiments. Some customers will grab many more condiment packets than they plan to use for the meal and frequently bring back the extra condiments for home use. While this practice may benefit the consumer, it results in extra cost and reduced profits for the restaurant owner who buys the condiments. Other customers who grab too many condiments will simply throw them away after the meal which is bad for the environment due to the added volume of plastic waste produced.

Yet another drawback to condiment trays is that this practice does not lend itself to an easy way of monitoring condiment usage by the restaurant management. Condiment trays are refilled either when empty or close to empty and normally there is no exact accounting for condiment usage as typically the trays are filled with loose condiments poured out from a larger container such as a storage bin. Clearly, in spite of the high technology processes used to produce condiment packets themselves, the dispensing of these same condiments still relies on arcane old methods such as has been described. Indeed, there is a need to provide a modern approach that can address these issues of hygiene control, wasteful practices and poor inventory control.

BRIEF SUMMARY OF THE INVENTION

It is an object of the present invention to provide a condiment dispenser that dispenses condiments in packet form.

It is another object of the present invention to provide a condiment packet dispenser that can dispense condiments automatically by pressing a button.

It is yet another object of the present invention to provide a condiment packet dispenser that dispenses individual packets, one packet at a time.

It is still another object of the present invention to provide a condiment packet dispenser that allows the customer to select from a plurality of different condiments.

It is a further object of the present invention to provide a condiment packet dispenser that is easy to refill when either low or empty.

It is yet another object of the present invention to provide a condiment packet dispenser that efficiently stores condiments using cylindrical shaped storage containers.

It is also another object of the present invention to provide a condiment packet dispenser that is designed to improve hygienic conditions in environments such as fast food restaurants.

DETAILED DESCRIPTION OF THE INVENTION

Figure 1:
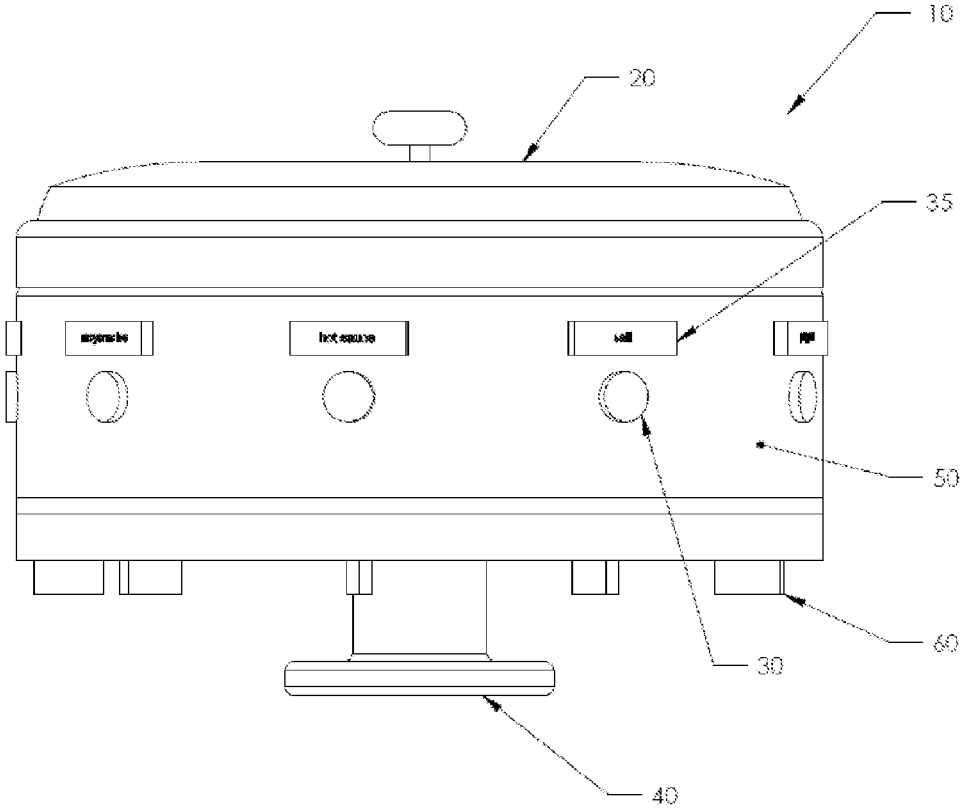
FIG. 1 is a front view of the condiment packet dispenser showing the external features of the invention.

Referring now to the drawings and in particular FIG. 1, a condiment packet dispenser according to the present invention is generally designated by reference numeral 10. Dispenser 10 has a lid 20 which rests on top of the main housing body 50. The main housing body 50 is preferably a cylindrical shape and contains various additional elements inside which will be described in further detail. Equally spaced on the outside wall of body 50 are push buttons 30 and condiment identification labels 35. The main body 50 rests centered and on top of a base 40. Equally spaced along the bottom surface of main body 50 are condiment packet drop chutes 60.

Figure 2:
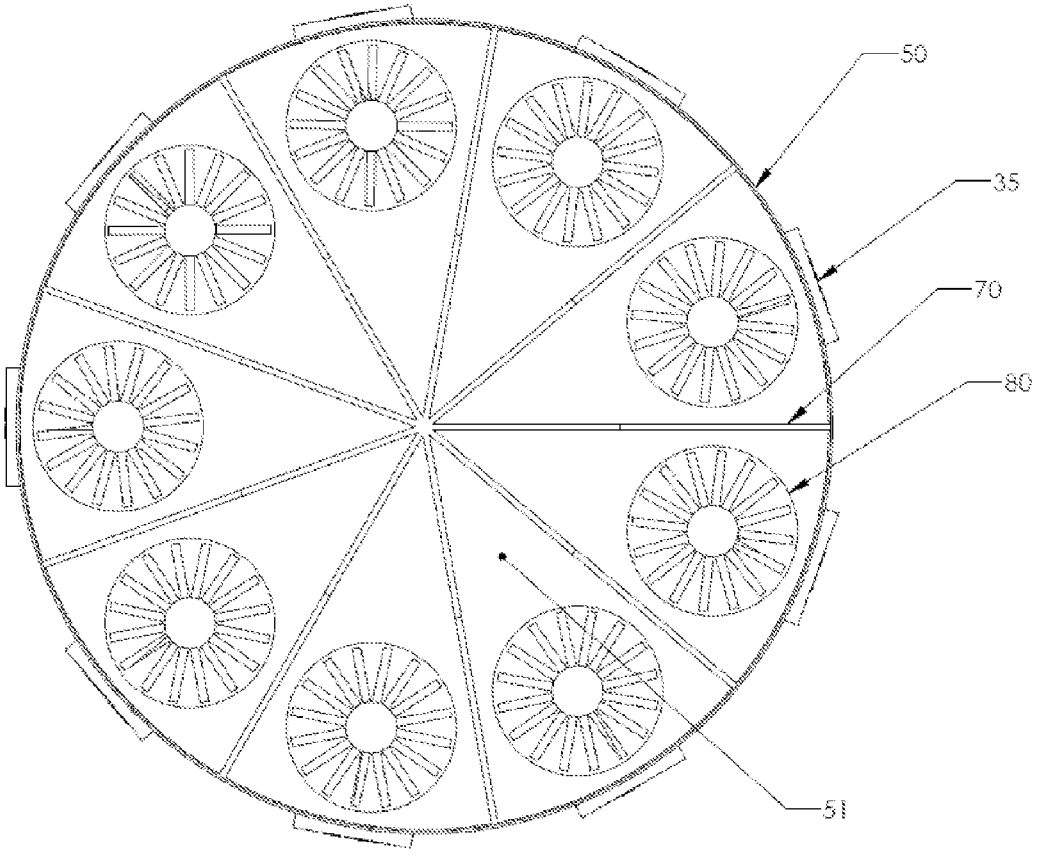
FIG. 2 is a top view of the condiment packet dispenser with the top lid removed to show internal features of the invention.

Referring next to FIG. 2, the dispenser 10 is shown in a top view with lid 20 removed so as to show additional internal components. The main body 50 is equally divided into individual condiment storage compartments 51 by using partition walls 70. It should be mentioned that although nine condiment storage compartments 51 are shown in this preferred embodiment, other dispensers designs having more or less than nine condiment storage compartments are also possible with this invention. Each condiment storage compartment 51 houses a single condiment packet storage container 80. The purpose of the condiment storage container 80 is to store a plurality of individual condiment packets in a specific radial orientation.

Figure 3:
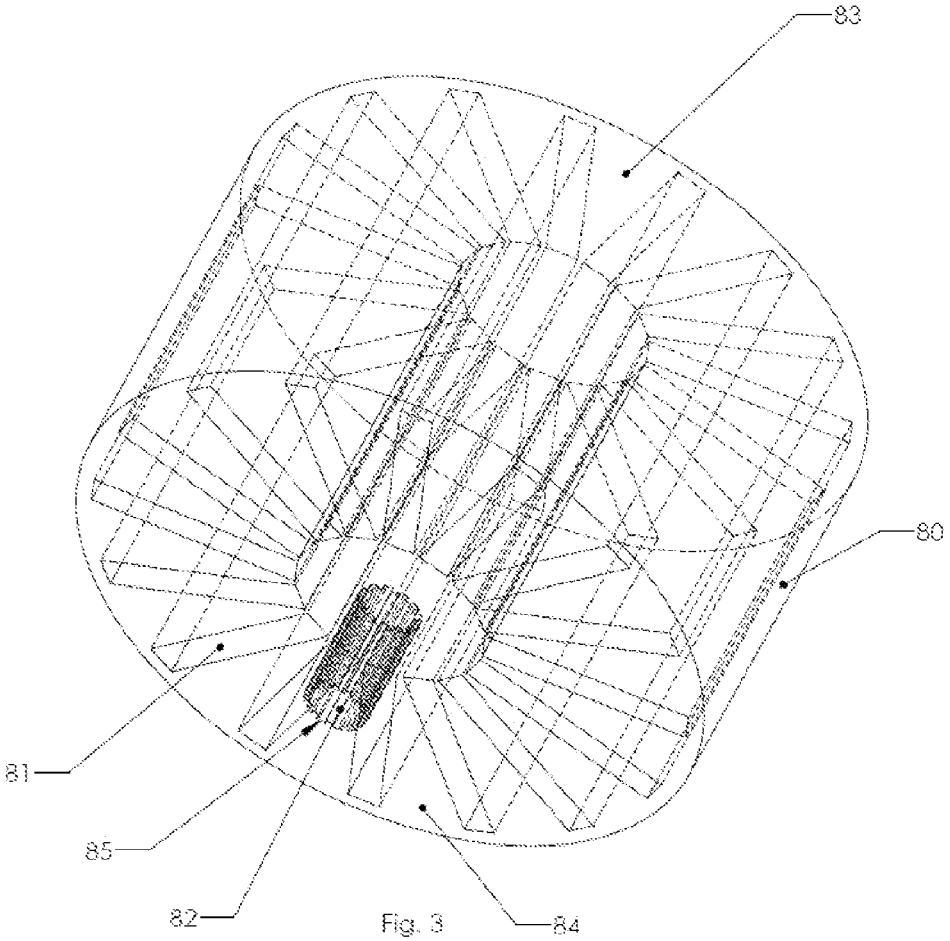
FIG. 3 is an isometric view of the condiment packet storage container including all hidden lines to show the internal features of the component.

Referring next to FIG. 3, the condiment packet storage container 80 is shown by itself in further detail. It is the intent of each condiment packet storage container 80 to house a plurality of condiment packets containing only one type of condiment. For example one container 80 may house only relish packets and yet another container 80 may house only mustard packets. In order to house a plurality of condiment packets of a specific type, each container 80 contains a plurality of packet slots 81. The slots 81 are preferably equally spaced in a radial orientation with respect to the container 80. In this preferred embodiment, the container 80 has a total of sixteen packet slots 81. However, additional designs are also possible that contain more or less than sixteen slots 81. The slots 81 are made large enough to allow a condiment packet to fit loosely inside such that the longer length side of the condiment packet is parallel to the longer length side of the slot 81. Typical condiment packets are rectangular in shape with a shorter top side and a longer side length. The slots 81 are made in a similar rectangular shape to allow packets to be loaded in from the top face of the container 83. It should be noted that the slots 81 extend fully through the entire container body length. The purpose for this is so that the packet slot 81, when aligned with another slot contained in the dispenser, will allow a packet to fall thru the bottom face 84 of container 80 under by gravity.

FIG. 3 also shows container 80 with a bottom side 84 having both a plurality of slots 81 as well as a spur gear 82. Said spur gear 82 is concentrically centered with the cylindrical shape of the container 80 and extends only in the downward direction. The purpose of the spur gear 82 is to allow the container 80 to be rotated in incremental angular steps. This movement will be further described in greater detail in subsequent figures. The spur gear contains a plurality of teeth 85 which are designed to engage with another spur gear for purposes of rotational movement.

Figure 4:
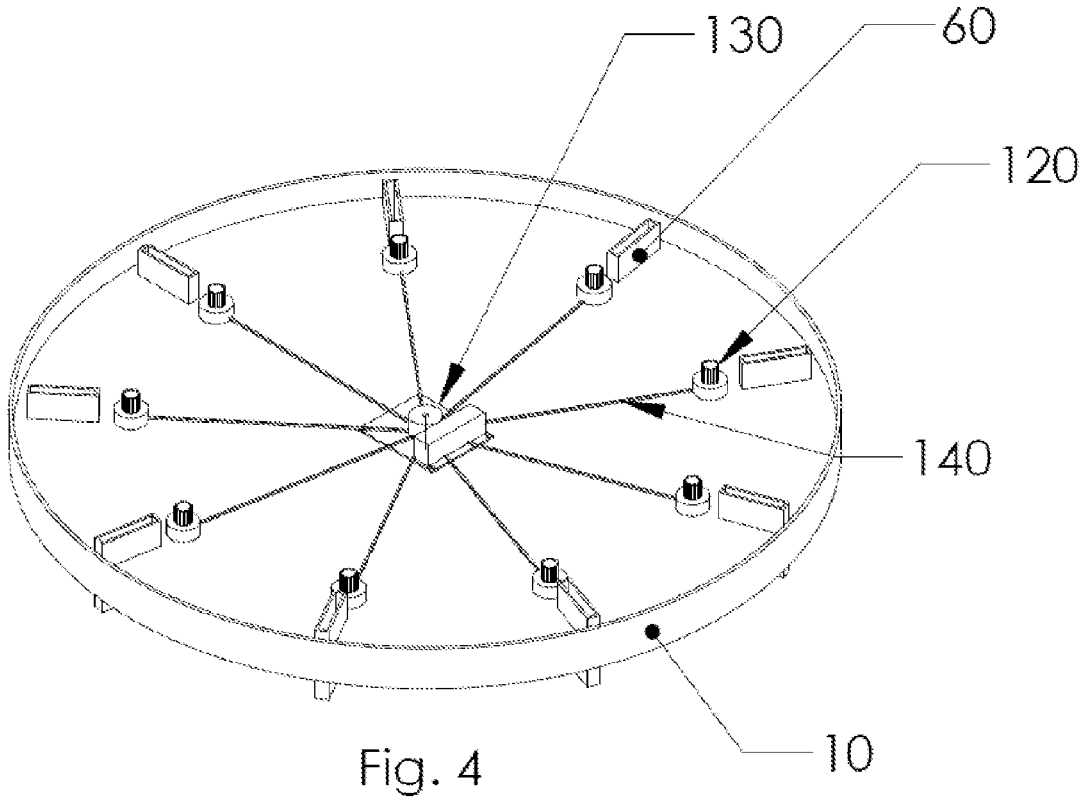
FIG. 4 is an isometric view of the motor and motor control board components with the top portions of the dispenser removed for better clarity.
Figure 6:
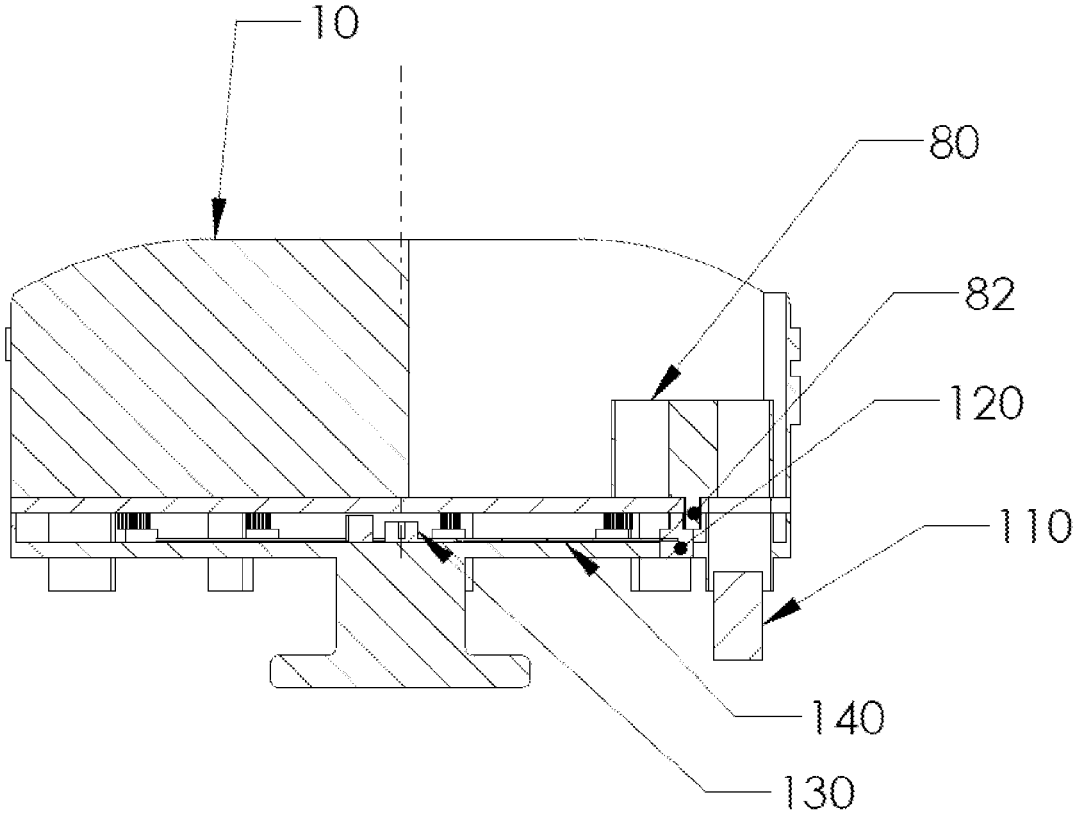
FIG. 6 is a cross sectional view cut across one of the condiment packet storage compartments to show how the motor, control board and condiment packet storage containers function together.

Referring now to FIGS. 1, 4 and 6, the operation of the condiment packet dispenser 10 is to be discussed next. First, the customer using dispenser 10 will choose which condiment is to be dispensed. Each condiment has a specific identification label 35 which is adjacent to a selection button 30. Pushing the selection button 30 then sends a signal to activate an electronic control board 130 which is shown in FIG. 4. Commonly used methods of sending an activation signal from the button 30 to the control board 130 may be used such as DC wire connections or RF switch activation by using an embedded RF antenna in the control board 130. Once activated, the control board 130 then sends a timed power signal via motor power wire 140 to the appropriate dispenser motor 120 which powers the motor to rotate for only a short angular displacement. The rotation of the motor then turns the condiment storage chamber 80 which communicates with the motor by spur gear 82. The duration of the motor rotation is timed such that the storage chamber 80 will always rotate so that the next condiment dispenser slot 81 is aligned with the dispenser drop chute 60 as shown in FIG. 4.

Figure 5:
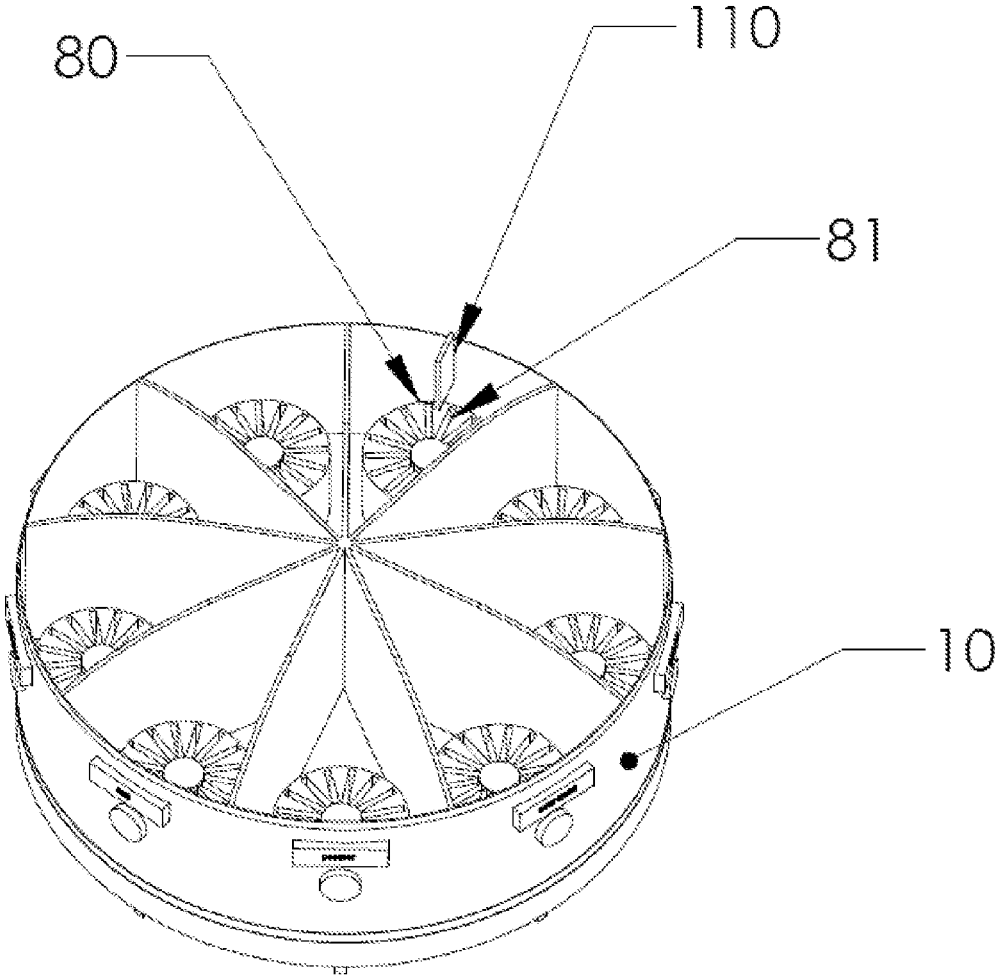
FIG. 5 is an isometric view of the dispenser with the top lid removed to show how individual condiment packets may be loaded into the condiment packet storage containers inside the dispenser.

Once the condiment storage container 80 aligns with the slot of the drop chute 60, the condiment packet contained in slot 81 will fall by gravity through the drop chute 60 and exit the bottom of dispenser 10 falling onto the table surface on which the dispenser has been placed. The source of power for dispenser 10 is not limited to, but may include common power sources such as AC power connection to a common 110 volt wall outlet or may be DC powered using common DC batteries such as 9 volt, AA, C or D type batteries. Loading of new condiments is simply done by lifting lid 20 and loading condiment packets 110 into the top open slots 81 of condiment packet containers 80 as shown in FIG. 5.

Referring back to FIG. 1, the base 40 may either be rigidly fixed to dispenser main body 50 or may include commonly used mechanical components such as ball bearings to allow the main body 50 to freely rotate with respect to the axis of the fixed base 40. The preferred material to be used in construction of the dispenser housing 50 is stainless steel for reasons of its common use in the food service industry and ability to sanitize.

What is claimed is:

1. A condiment packet dispenser comprising:

a cylindrical shaped housing containing an open top with a plurality of radially partitioned chambers and a closed bottom end having a set of equally spaced radial slots in communication with each radially partitioned chamber, wherein the radial slots function as chutes to define a dispensing path for the condiment packets, a cylindrical shaped top lid which is removable and is attached to the open top of said housing, a plurality of cylindrical condiment packet storage containers, each storage container having a set of equally spaced radial slots extending along a length of the storage container wherein said radial slots retain a condiment packet to be dispensed, each cylindrical condiment packet storage container engaged to a spur gear concentrically located on a bottom face of the closed bottom end, a plurality of condiment selection buttons disposed on the cylindrical shaped housing each associated with identification labels, a motor control unit electrically connected to a plurality of electric motors and a plurality of selection buttons wherein an actuation of the selection button results in a corresponding spur gear to rotate the condiment packet storage container to dispense a selected condiment packet, a rotating base stand attached to a bottom of said cylindrical housing.

2. The condiment packet dispenser according to claim 1 wherein the dispenser can store between two to twenty different condiment packet storage containers.

3. The condiment packet dispenser according to claim 1 wherein each condiment packet storage container may store between two to thirty condiment packets.

4. The condiment packet dispenser according to claim 1 wherein the selection button is able to generate an electronic activation signal which communicates with said motor control unit either through a direct wired connection or through RF signal transmission.

5. The condiment packet dispenser according to claim 1 wherein the base stand is rigidly connected to the bottom face of said housing.

6. The condiment packet dispenser according to claim 1 wherein the base contains a mechanism to allow the housing to rotate a full 360 degrees around the axis of the base.

* * * * *